US007615328B2

(12) United States Patent
Sacripante et al.

(10) Patent No.: US 7,615,328 B2
(45) **Date of Patent: *Nov. 10, 2009**

(54) LOW MELT TONERS AND PROCESSES THEREOF

(75) Inventors: Guerino G. Sacripante, Oakville (CA); Fatima M. Mayer, Mississauga (CA); Kimberly D. Nosella, Mississauga (CA); Valerie M. Farrugia, Oakville (CA); Raj D. Patel, Oakville (CA); Milan Maric, Montreal (CA); Allen K. Chen, Oakville (CA); Edward G. Zwartz, Mississauga (CA); T. Hwee Ng, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/140,738

(22) Filed: Jun. 17, 2008

(65) Prior Publication Data

US 2009/0061349 A1 Mar. 5, 2009

Related U.S. Application Data

(62) Division of application No. 10/948,450, filed on Sep. 23, 2004, now Pat. No. 7,402,371.

(51) Int. Cl.
*G03G 5/00* (2006.01)

(52) U.S. Cl. ..... 430/137.14; 430/109.4

(58) Field of Classification Search ..... 430/108.1, 430/108.3, 109.4, 137.14, 123.5, 123.51, 430/125.56

See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 4,254,207 | A | 3/1981 | Landoll et al. | |
| 4,298,672 | A | 11/1981 | Lu | |
| 4,338,390 | A | 7/1982 | Lu | |
| 4,385,107 | A | 5/1983 | Tanaka et al. | |
| 4,543,313 | A | 9/1985 | Mahabadi et al. | |
| 4,891,293 | A | 1/1990 | Sacripante et al. | |
| 4,952,477 | A | 8/1990 | Fuller et al. | |
| 4,973,539 | A | 11/1990 | Sacripante et al. | |
| 4,990,420 | A | 2/1991 | Urabe | |
| 5,057,392 | A | 10/1991 | McCabe et al. | |
| 5,147,747 | A | 9/1992 | Wilson et al. | |
| 5,166,026 | A | 11/1992 | Fuller et al. | |
| 6,080,519 | A | 6/2000 | Ishiyama et al. | |
| 6,214,507 | B1 | 4/2001 | Sokol et al. | |
| 6,383,205 | B1 | 5/2002 | Samson et al. | |
| 6,413,691 | B2 | 7/2002 | Daimon et al. | |
| 6,582,869 | B2 | 6/2003 | Daimon et al. | |
| 6,821,698 | B2 | 11/2004 | Sawada et al. | |
| 6,998,212 | B2 | 2/2006 | Shirai et al. | |
| 7,402,371 | B2 * | 7/2008 | Sacripante et al. | ..... 430/137.14 |
| 2004/0142266 | A1 | 7/2004 | Sacripante et al. | |

OTHER PUBLICATIONS

Kirk Othmer Encyclopedia of Chemical Technology, Fourth Edition, vol. 19, pp. 888-894, A Wiley- Interscience Publication, John Wiley & Sons.

* cited by examiner

*Primary Examiner*—Mark A Chapman
(74) *Attorney, Agent, or Firm*—Fay Sharpe LLP

(57) ABSTRACT

A process for preparing toner particles and compositions adapted for use in preparing toners that comprise a blend of a first polyester resin with a second sharp melting polyester resin. The process includes forming an emulsion resin comprising a branched polyester resin, a crystalline polyester resin, a colorant, and optionally a wax. The resin mixture is aggregated using an aggregating agent, such as a zinc acetate solution, to form an aggregate mixture. The aggregate mixture is then coalesced at a temperature of from about 5 to about 20° C. above the $T_g$ of the emulsion resin to produce the resultant toner particles.

3 Claims, No Drawings

LOW MELT TONERS AND PROCESSES THEREOF

This application is a divisional of U.S. patent application Ser. No. 10/948,450, filed Sep. 23, 2004, and incorporated herein in its entirety by reference.

BACKGROUND

The present disclosure relates, in various exemplary embodiments, to toner compositions and processes thereof. More specifically, the present disclosure relates to low melt toner compositions comprising a mixture of a branched amorphous polyester resin, a crystalline polyester resin, a colorant, and optionally a wax. Additionally, the present exemplary embodiments relate to processes for forming such toner compositions. This disclosure finds particular application in conjunction with xerographic or electrostatographic printing processes, and will be described with particular reference thereto. However, it is to be appreciated that the present exemplary embodiments are also amenable to other like applications.

Crystalline and branched resins are known. For example, crystalline refers to a polymer with a 3 dimensional order, and branched refers to a polymer with chains linked to form a crosslinked network.

Xerographic toners of a resin, a pigment, and a charge control agent are known. Toners useful for xerographic applications should exhibit certain performances related to storage stability, and particle size integrity, that is, it is desired to have the particles remain intact and not agglomerate until they are fused on paper. Since environmental conditions vary, the toners also should not substantially agglomerate up to a temperature of from about 50° C. to about 55° C. The toner composite of resins and colorant should also display acceptable triboelectrification properties which vary with the type of carrier or developer composition. A valuable toner attribute is the relative humidity sensitivity ratio, that is, the ability of a toner to exhibit similar charging behavior at different environmental conditions such as high humidity or low humidity. Typically, the relative humidity of toners is considered as the ratio between the toner charge at 80 percent humidity divided by the toner charge at 20 percent humidity. Acceptable values for relative humidity sensitivity of toner vary, and are dependant on the xerographic engine and the environment. Typically, the relative humidity sensitivity ratio of toners is expected to be at least 0.5 and preferable 1.

Another important property for xerographic toner compositions is its fusing properties on paper. Due to energy conservation measures, and more stringent energy characteristics placed on xerographic engines, such as on xerographic fusers, there has been pressure to reduce the fixing temperatures of toners onto paper, such as achieving fixing temperatures of from about 90° to about 120° C., to permit less power consumption and allowing the fuser system to possess extended lifetimes. For a noncontact fuser, that is a fuser that provides heat to the toner image on paper by radiant heat, the fuser usually is not in contact with the paper and the image. For a contact fuser, that is a fuser which is in contact with the paper and the image, the toners should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Another desirable characteristic is sufficient release of the paper image from the fuser roll. For oil containing fuser rolls, the toner compositions may not contain a wax. For fusers without oil on the fuser (usually hard rolls), however, the toner composites will usually contain a lubricant like a wax to provide release and stripping properties. Thus, a toner characteristic for contact fusing applications is that the fusing latitude, that is the temperature difference between the fixing temperature and the temperature at which the toner offsets onto the fuser, should be from about 30° C. to about 90° C., and preferably from about 50° C. to about 90° C. Additionally, depending on the xerographic applications, other toner characteristics may be desired, such as providing high gloss images, such as from about 60 to about 80 Cardner gloss units, especially in pictorial color applications.

Other toner characteristics relate to nondocument offset, that is, the ability of paper images not to transfer onto adjacent paper images when stacked up, at a temperature of about 55° C. to about 60° C.; nonvinyl offset properties; high image projection efficiency when fused on transparencies, such as from about 75 to about 100 percent projection efficiency and preferably from about 85 to 100 percent projection efficiency. The projection efficiency of toners can be directly related to the transparency of the resin utilized, and clear resins are desired.

Additionally, small sized toner particles, such as from about 3 to about 12 microns, and preferably from about 5 to about 7 microns, are desired, especially in xerographic engines wherein high resolution is a characteristic. Toners with the aforementioned small sizes can be economically prepared by chemical processes, also known as direct or "in Situ" toner process, and which process involves the direct conversion of emulsion sized particles to toner composites by aggregation and coalescence, or by suspension, microsuspension or microencapsulation processes.

Toner compositions are known, such as those disclosed in U.S. Pat. No. 4,543,313, the disclosure of which is totally incorporated herein by reference, and wherein there are illustrated toner compositions comprised of a thermotropic liquid crystalline resin with narrow melting temperature intervals, and wherein there is a sharp decrease in the melt viscosity about the melting point of the toner resin particles, thereby enabling matte finishes. The aforementioned toners of the '313 patent possess sharp melting points and can be designed for non-contact fusers such as Xenon flash lamp fusers generating 1.1 microsecond light pulses. For contact fusing applications, sharp melting materials can offset onto the fuser rolls, and thus the toners of the '313 patent may possess undesirable fusing latitude properties.

In U.S. Pat. No. 4,891,293, there are disclosed toner compositions with thermotropic liquid crystalline copolymers, and wherein sharp melting toners are illustrated. Moreover, in U.S. Pat. No. 4,973,539 there are disclosed toner compositions with crosslinked thermotropic liquid crystalline polymers with improved melting characteristics as compared, for example, to the thermotropic liquid crystalline resins of the '313 or '293 patents.

Furthermore, it is known that liquid crystalline resins may be opaque and not clear, and hence such toners are believed to result in poor projection efficiencies. The toners of the present exemplary embodiment in contrast are comprised of a crystalline resin with sharp melting characteristics, and a branched resin with a broad molecular weight, and wherein there are permitted fusing characteristics, such as lower fixing temperatures of from about 90° C. to about 120° C. and a broad fusing latitude of from about 50° C. to about 90° C., with contact fusers with or without oil. Furthermore, a crystalline portion of from about 5 to about 40 percent of the toner is believed to be dispersed in small domains within the amorphous and clear branched resin, and with domain diameter sizes of, for example, less than or equal to about 100 to about 2,000 nanometers, and more specifically, from about 50 to about 300 nanometers, and such that the high projection efficiency is maintained. Thus, while the crystalline resins employed in the toner particles of the present disclosure are also opaque, high projection efficiency is maintained because, without being bound to any particular theory, resin is dispersed in the branched resin with sizes of about less than 300-400 nanometers. Projection efficiencies of from about 70 to about 90 percent may be maintained depending on the colorant used.

Low fixing toners comprised of semicrystalline resins are also known, such as those disclosed in U.S. Pat. No. 5,166,026, and wherein toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of semicrystalline polyolefin and copolymers thereof with a melting point of from about 50° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of semicrystalline polyolefin and copolymers thereof with a melting point of from about 50° C. to about 100° C. and pigment particles are disclosed. Although, it is indicated that some of these toners may provide low fixing temperatures of about 200° F. to about 225° F. (degrees Fahrenheit) using contact fusing applications, the resins are derived from components with melting characteristics of about 30° C. to about 50° C., and which resins are not believed to exhibit more desirable melting characteristics, such as about 55° C. to about 60° C.

In U.S. Pat. No. 4,990,424 toners comprised of a blend of resin particles containing styrene polymers or polyesters, and components selected from the group consisting of semicrystalline polyolefin and copolymers thereof with a melting point of from about 50° C. to about 100° C. are disclosed. Fusing temperatures of from about 250° F. to about 330° F. (degrees Fahrenheit) are reported.

Low fixing crystalline based toners are disclosed in U.S. Pat. No. 6,413,691, and wherein a toner comprised of a binder resin and a colorant, the binder resin containing a crystalline polyester containing a carboxylic acid of two or more valences having a sulfonic acid group as a monomer component, are illustrated. The crystalline resins of the '691 patent are believed to be opaque, resulting in low projection efficiency.

Crystalline based toners are disclosed in U.S. Pat. No. 4,254,207. Low fixing toners comprised of crosslinked crystalline resin and amorphous polyester resin are illustrated in U.S. Pat. Nos. 5,147,747 and 5,057,392, and wherein the toner powder is comprised, for example, of polymer particles of partially carboxylated crystalline polyester and partially carboxylated amorphous polyester that has been crosslinked together at elevated temperature with the aid of an epoxy novolac resin and a crosslinking catalyst.

Copending U.S. patent application Ser. No. 10/349,548, which is published as U.S. Patent Application No. U.S. 2004/0142266, is directed to toner compositions comprising amorphous polyester resins and crystalline polyester resins and a process for making such toners. The present disclosure is directed to a new process for making toners comprising amorphous polyester resins and crystalline polyester resins. Additionally, the present disclosure is directed to toners comprising lithio-sulfonated branched polyester resins and lithio-sulfonated crystalline polyester resins.

Also of interest are U.S. Pat. Nos. 6,383,205 and 4,385,107, the disclosures of which are totally incorporated herein by reference.

Polyester based emulsion/aggregation resins comprising a combination of a first resin component with a second resin component having significantly different melt flow properties than the first resin (such as a sharp melting crystalline resin) may be prepared via direct coalescence method or process. Forming such toners by direct coalescence, however, may be limited in terms of particle growth control, morphology and yields (generally providing low yields).

There is thus a need to provide low melt and ultra low melt toners. There is thus also a need to provide a process for preparing such low melt emulsion aggregation toners that allows for controlled particle growth, controlling morphology or shape, and provides high yields.

BRIEF DESCRIPTION

It is a feature of the present exemplary embodiment to provide toners comprised of a crystalline resin, a branched amorphous resin, a colorant and optionally a wax.

Moreover, it is a feature of the present exemplary embodiment to provide a toner with low fixing temperatures, such as from about 90° C. to about 120° C.

It is another feature of the present exemplary embodiment to provide a toner with a broad fusing latitude, such as from about 50° C. to about 90° C.

In yet another feature of the present exemplary embodiment there is provided a toner which displays a glass transition of from about 45° C. to about 75° C. as measured by the known differential scanning calorimeter.

In another aspect, the present exemplary embodiment provides a process for preparing a low melt toner, the process comprising forming a pre-toner mixture comprising a first alkali sulfonated polyester resin, a second alkali sulfonated polyester resin, and a colorant, adding an aggregating agent to the pre-toner mixture and aggregating the mixture to form an aggregate mix comprising a plurality of aggregate toner particles, coalescing the aggregate mix at a temperature of from about 5 to about 20° C. above the glass transition temperature ($T_g$) of one of the first or second alkali sulfonated polyester resins to form a mixture of coalesced toner particles, and cooling the mixture of coalesced toner particles.

In still another aspect, the present exemplary embodiment provides a method form forming low melt polyester based toner, the method comprising forming an emulsion resin comprising a branched amorphous polyester resin component and a crystalline polyester resin component, forming a pre-toner mixture by adding a colorant and optionally a wax to the emulsion resin, homogenizing the pre-toner mixture, aggregating the pre-toner mixture by adding an aggregating agent, thereby forming an aggregate mixture comprising a plurality of aggregate toner particles, coalescing the aggregate mixture by heating the aggregate mixture to a temperature of from about 5 to about 20° C. above the glass transition temperature of the branched amorphous polyester resin component, thereby generating a mixture of coalesced toner particles, and cooling said toner particles to room temperature.

In a further aspect, a process for preparing low melt toner compositions is provided that includes a method for forming a low melt toner, the method comprising forming a pre-toner mixture comprising (i) an emulsion resin comprising a first alkali sulfonated polyester resin and a second alkali sulfonated polyester resin, (ii) a colorant, and (iii) optionally a wax, adjusting the pH of the pre-toner mixture to between about 4 to about 5, homogenizing the pre-toner mixture, forming an aggregate mixture by adding an aggregating agent over a period of about 10 to about 60 minutes, adjusting the pH of the aggregate mixture to between about 5 and about 7, heating the aggregate mixture to a temperature of from about 50 to about 80° C. thereby forming a mixture coalesced toner particles, adjusting the pH of the mixture of coalesced toner particles to between about 5 and about 7, and cooling the mixture of coalesced toner particles to room temperature.

In yet another aspect, a toner is provided comprising a lithio-sulfonated branched amorphous polyester resin, a lithio-sulfonated crystalline polyester resin, a colorant, and optionally a wax, wherein the ratio of the lithio-sulfonated branched amorphous polyester resin to the lithio-sulfonated crystalline polyester resin is from about 65/35 to about 80/20. In further embodiments the ratio of the lithio-sulfonated branched amorphous polyester resin to the lithio-sulfonated crystalline polyester resin is about 75/25.

DETAILED DESCRIPTION

Aspects of the present exemplary embodiment relate to a toner composition comprising a branched amorphous resin or polymer, a crystalline resin or polymer, and a colorant. Optionally, the toner composition may include a wax. In embodiments, the branched amorphous resin and the crystalline resin are each alkali sulfonated polyester resins. The alkali metal in the respective sulfonated polyester resins may independently be lithium, sodium, potassium or other materials from the Group I alkali metals. In embodiments the alkali metal is independently selected from the group consisting of lithium, sodium, potassium and combinations thereof. In further embodiments, the branched amorphous resin and the crystalline resin are each a lithium sulfonated polyester resin. The toner compositions are low melt toners that exhibit a relatively low minimum fix temperature of about 90 to about 120° C. Other features and characteristics of the toner compositions are described herein.

The present toners include a crystalline resin. The crystalline resin is, in embodiments, an alkali sulfonated polyester resin. Examples of polyester based crystalline resins include, but are not limited to alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), and alkali copoly (5-sulfo-iosphthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isopthaloyl)-copoly (hexylene-adipate), alkali copoly(5-sulfo-isophthaloyl)-copoly(octylene-adipate), alkali copoly(5-sulfoisophthaloyl)-copoly(ethylene-succinate), alkali copoly (5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly (pentylene-adipate), alkali copoly(5-sulfo-isophthaloyl) copoly(hexylene-adipate), poly(octylene-adipate), and wherein alkali is a metal like sodium, lithium or potassium. In embodiments, the alkali metal is lithium.

The crystalline resin is, in embodiments, present in an amount of from about 5 to about 30 percent by weight of the toner components, and, in other embodiments, from about 15 to about 25 percent by weight of the toner components. The crystalline resin can possess various melting points of, for example, from about 30° C. to about 120° C., and may be, in embodiments, from about 50° C. to about 90° C. The crystalline resin may have, for example, a number average molecular weight ($M_n$), as measured by gel permeation chromatography (GPC) of, for example, from about 1,000 to about 50,000, and may be from about 2,000 to about 25,000. The weight average molecular weight ($M_w$) of the resin may be, for example, from about 2,000 to about 100,000, and preferably from about 3,000 to about 80,000, as determined by gel permeation chromatography using polystyrene standards. The molecular weight distribution ($M_w/M_n$) of the crystalline resin is, for example, from about 2 to about 6, and more specifically, from about 2 to about 4.

The crystalline resins can be prepared by the polycondensation process of reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride, thereof; and an alkali sulfo-organic diacid such as the sodio, lithio or potassium salt of dimethyl-5-sulfo-isopthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-d icarbometh-oxybenzene, sulfo-terephthalic acid, dimethyl-sulfo-terephthalate, 5-sulfoisophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. The present toners also include a branched amorphous resin. In embodiments, the branched amorphous resin is an alkali sulfonated polyester resin. Examples of suitable alkali sulfonated polyester resins include, but are not limited to, the metal or alkali salts of copoly(ethylene-terephthalate)-copoly-(ethylene-5-sulfo-isophthalate), copoly(propy-lene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

The present toners also include a branched amorphous resin. In embodiments, the branched amorphous resin is an alkali sulfonated polyester resin. Examples of suitable alkali sulfonated polyester resins include, but are not limited to, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly (ethoxylated bisphenol-A-5-sulfo-isophthalate), and wherein the alkali metal is, for example, a sodium, lithium or potassium ion.

The branched amorphous polyester resin, in embodiments, possess, for example, a number average molecular weight ($M_n$), as measured by gel permeation chromatography (GPC), of from about 10,000 to about 500,000, and may be from about 5,000 to about 250,000; a weight average molecular weight ($M_w$) of, for example, from about 20,000 to about 600,000, and may be from about 7,000 to about 300,000, as determined by gel permeation chromatography using polystyrene standards; and wherein the molecular weight distribution ($M_w/M_n$) is, for example, from about 1.5 to about 6, and more specifically, from about 2 to about 4. The onset glass transition temperature ($T_g$) of the resin as measured by a differential scanning calorimeter (DSC) is, in embodiments, for example, from about 55° C. to about 70° C., and more specifically, from about 55° C. to about 67° C.

The branched amorphous polyester resins are generally prepared by the polycondensation of an organic diol, a diacid or diester, a sulfonated difunctional monomer, and a multivalent polyacid or polyol as the branching agent and a polycondensation catalyst.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, d iethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected can vary, and more specifically, is, for example, from about 45 to about 52 mole percent of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-d icarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 weight percent of the resin can be selected.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Branching agents include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Various known suitable colorants, such as dyes, pigments, and mixtures thereof and present in the toner containing the polyester generated with the processes describe in the present disclosure in an effective amount of, for example, from about 1 to about 25 percent by weight of the toner. In embodiments, the colorant is present in an amount of from about 2 to about 12 weight percent. In other embodiments, the colorant is present in am amount of from about 3 to about 11 weight percent. Suitable colorants include black colorants like REGAL 330®; magnetites, such as Mobay magnetites MO8029™, MO8060™; Columbian magnetites; MAPICO BLACKS™ and surface treated magnetites; Pfizer magnetites CB4799 ™, CB5300™, CB5600™, MCX6369 ™; Bayer magnetites, BAYFERROX 8600™, 8610™; Northern Pigments magnetites, NP-604™, NP-608™; Magnox magnetites TMB-100™, or TMB-104™; and the like. Suitable colored pigments, or colorants include but are not limited to, there can be selected cyan, magenta, yellow, red, green, brown, blue colorants or mixtures thereof. Specific examples of pigments include phthalocyanine HELIOGEN BLUE L6900T, D6840T, D7080T, D7020T, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, and Anthrathrene Blue, identified in the Color Index as CI-69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Known suitable effective positive or negative charge enhancing additives can be selected for the toner compositions of the present disclosure such additives may be present preferably in an amount of about 0.1 to about 10, and may be present in an amount of about 1 to about 3 percent by weight. Examples of these additives include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

There can also be blended with the toner compositions of the present disclosure other toner additives, such as external additive particles including flow aid additives, which additives are usually present on the surface thereof. Examples of these additives include metal oxides like titanium oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and in other embodiments, in an amount of from about 0.1 percent by weight to about 1 percent by weight. Several of the aforementioned additives are illustrated in U.S. Pat. Nos. 3,590,000; 3,800,588, and 6,214,507, the disclosures which are totally incorporated herein by reference.

Optionally, the toner compositions may also include a wax. Examples of suitable waxes include, but are not limited to polypropylenes and polyethylenes commercially available from Allied Chemical and Petrolite Corporation, wax emulsions available from Michaelman, Inc. and the Daniels Products Company, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected possess, it is believed, a molecular weight (MW) of from about 1,000 to about 1,500, while the commercially available polypropylenes utilized for the toner compositions of the present disclosure are believed to have a molecular weight of from about 4,000 to about 5,000. Examples of functionalized waxes include, such as amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro is Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson wax.

The amount of the various components present in the toner may vary, and may depend on the particular colorant utilized and the desired particular size of the toner. In embodiment, the crystalline resin is generally present in the toner in an amount of from about 10 to about 40 percent by weight. In other embodiment, the crystalline resin is present in an amount of from about 15 to about 25 percent by weight. The branched amorphous resin is generally present in the toner in an amount of from about 60 to about 90 percent by weight. In embodiments, the branched amorphous resin is present in an amount of from about 70 to about 85 percent by weight.

The colorant is generally present in an amount of from about 2 to about 15 percent by weight, and may be present in an amount of from about 3 to about 11 percent by weight. Optionally, a wax can be present in an amount of from about 4 to about 12 percent by weight, and in other embodiments may be present in an amount of from about 8 to about 12 percent by weight. The toner components amount to 100 percent of the toner by weight.

The resulting toner particles can possess an average volume particle diameter of about 2 to about 25 microns, and may be from about 3 to about 15 microns, or from about 5 microns. In embodiments, the particles may have a geometric size distribution (GSD) of about 1.40 of less. In other embodiments, the toner particles have a GSD of about 1.25 or less, and, in further embodiments, the GSD may be less than about 1.23. In still other embodiments, the particles have a size of about 6 micron with a GSD of less than about 1.23. In some embodiments, the toner particles have a particle size of about 3 to about 12 microns. In other embodiments, the toner particles have a particle size of about 6 microns. In other embodiments, the toner particles have a particle size of from about 5 to about 8.5 microns.

In embodiments, the toners include a sodium sulfonated branched amorphous polyester resin, a sodium sulfonated crystalline polyester resin, a colorant, and optionally a wax. In further embodiments, the toners include a lithium sulfonated branched amorphous polyester resin, a lithium sulfonated crystalline polyester resin, a colorant, and optionally a wax. In still other embodiments, the toners include a sodium sulfonated branched amorphous polyester resin, a lithium sulfonated crystalline polyester resin, a colorant, and optionally a wax. In yet other embodiment, the toner may comprise an alkali sulfonated amorphous polyester resin, an alkali sulfonated crystalline polyester resin, a colorant and optionally a wax, wherein the polyester resins each include an alkali metal independently selected from lithium, sodium, and potassium. Alternatively, the alkali metal may be independently selected from any of the Group I alkali metal ions.

Another aspect of the present exemplary embodiment relates to a process for producing the present toner compositions. In embodiments, the present toners may be made by a variety of known methods, including a direct coalescence process.

In other embodiments, toners in accordance may be prepared by a process that includes aggregating a mixture of a colorant, optionally a wax, and an emulsion resin comprising a branched amorphous resin and a crystalline resin, and then coalescing the aggregate mixture. An emulsion resin is prepared by combining or mixing a branched amorphous resin and a crystalline resin. A pre-toner mixture is prepared by adding a colorant, and optionally a wax or other materials suitable for use in a toner, to the emulsion resin. In embodiments, the pH of the pre-toner mixture is adjusted to between about 4 to about 5. The pH of the pre-toner mixture may be adjusted by an acid such as, for example, acetic acid, nitric acid or the like, or a base such as, for example, sodium hydroxide. Additionally, in embodiments, the pre-toner mixture optionally may be homogenized. If the pre-toner mixture is homogenized, homogenization may be accomplished by mixing at about 600 to about 4,000 revolutions per minute. Homogenization may be accomplished by any suitable means, including, for example, an IKA Ultra Turrax T50 probe homogenizer.

Following the preparation of the pre-toner mixture, an aggregate mixture is formed by adding an aggregating agent to the pre-toner mixture. The aggregating agent is generally an aqueous solution of a metal salt. The aggregating agent is, in embodiments, selected from the group consisting of zinc acetate, zinc chloride, zinc bromide, magnesium acetate, magnesium bromide, aluminum chloride, poly-aluminum chloride, calcium chloride, calcium acetate, copper chloride, copper sulfate, combinations thereof, and the like. In embodiments, the aggregating agent is added to the pre-toner mixture at a temperature that is below the glass transition temperature ($T_g$) of the emulsion resin. The aggregating agent is generally added to the pre-toner mixture over a period of from about 10 to about 60 minutes. Aggregation may be accomplished with or without maintaining homogenization.

Following aggregation, the aggregates are coalesced. Coalescence may be accomplished by heating the aggregate mixture to a temperature that is about 5 to about 20° C. above the $T_g$ of the amorphous polyester resin. Generally, the aggregate mixture is heated to a temperature of about 50 to about 80° C. In embodiments, coalescence is accomplished by also stirring the mixture at a temperature of from about 200 to about 750 revolutions per minute. Coalescence may be accomplished over a period of from about 3 to about 9 hours.

Optionally, during coalescence, the particle size of the toner particles may be controlled and adjusted to a desired size by adjusting the pH of the mixture. Generally, to control the particle size, the pH of the mixture is adjusted to between about 5 to about 7 using a base such as, for example, sodium hydroxide. In addition, the pH of the aggregate mixture may be adjusted by adding a base selected from the group consisting of sodium hydroxide, potassium hydroxide, ammonium hydroxide, sodium bicarbonate, and mixtures thereof.

After coalescence, the mixture is cooled to room temperature. After cooling, the mixture of toner particles is washed with water and then dried. Drying may be accomplished by any suitable method for drying including freeze drying. Freeze drying is typically accomplished at temperatures of about −80° C. for a period of about 72 hours.

The process may or may not include the use of surfactants. In embodiments, surfactants are typically not utilized.

The present process or method for forming polyester based toners comprising a branched amorphous polyester resin and a crystalline polyester resin allows for controlling particle size and shape (morphology). As discussed, particle size may be controlled independently by adjusting the pH of the pre-toner mixture, by homogenizing the mixture at various steps, or by adjusting the pH of the mixture of the coalesced particles to between about 5 to about 7. Particle morphology is controlled in general by the process and temperature parameters.

The toners disclosed herein are sufficient for use in an electrostatographic or xerographic process. The present toners generally exhibit a minimum fixing temperature of from about 90 to about 120° C. The toners exhibit a glass transition temperature of from about 45 to about 75° C. The present toners exhibit satisfactory properties when used in a xerographic or electrostatographic process. Such properties include a high gloss, which may be in the range of from about 10 to about 90 gloss units, good C-zone and A-zone charging, a fusing latitude of from about 15 to about 90° C., and substantially no vinyl offset. In embodiments, charging properties may be optimized by the use for lithium as the alkali metal in the polyester resins.

Toner compositions and processes for producing such toners according to the present exemplary embodiments are further illustrated by the following examples. The examples are intended to be merely illustrative of the present exemplary embodiments and are not intended to limit the scope of the same.

EXAMPLE I

Preparation of a Branched Amorphous Lithium Sulfonated Polyester Resin Derived from 2 Mole Percent of Lithio 5-Sulfoisophthalic Acid A branched amorphous sulfonated polyester resin comprised of 0.48 mole equivalent of terephthalate, 0.020 mole equivalent of lithio 5-sulfoisophthalic acid, 0.351 mole equivalent of 1,2-propanediol, and 0.031 mole equivalent of diethylene glycol, 0.116 mole equivalent of dipropylene glycol, and trimethylolpropane as branching agent (0.02 mole equivalent) was prepared as follows. In a two-liter Hoppes reactor equipped with a heated bottom drain valve, high viscosity double turbine agitator, and distillation receiver with a cold water condenser was charged 872 grams of dimethylterephthalate, 47.2 grams of lithio 5-sulfoisophthalic acid, 658.1 grams of 1,2-propanediol (1 mole excess of glycols), 57.0 grams of di-ethylene glycol, (1 mole excess of glycols), 236.9 grams of dipropylene glycol, trimethylolpropane (11 grams) and 1.5 grams of butyltin hydroxide oxide as the catalyst. The reactor was heated to 190° C. with stirring for 3 hours and then again heated to 210° C. over a one hour period, after which the pressure was slowly reduced from atmospheric pressure to about 260 Torr over a one hour period, and then reduced to 5 Torr over a two hour period. The pressure was then further reduced to about 1 Torr over a 30 minute period and the polymer was discharged through the bottom drain onto a container cooled with dry ice to yield 880 grams of lithio sulfonated-polyester resin. The branched sulfonated-polyester resin had a glass transition temperature measured to be 62.0° C. (onset) and a softening point of 155° C. An aqueous emulsion of the resin was then prepared by dissolving the said resin (200 grams) in 2 Liters of acetone, and adding the dissolved solution drop wise (over a 2 hour period) into a 4 liter kettle, equipped with a heating mantle, a mechanical stirrer and distillation apparatus, and comprised of 2.25 liters of water heated to 80° C. The acetone was collected in the distillation receiver. The aqueous resin emulsion displayed a particle size of 225 nanometers.

EXAMPLE II

Preparation of a Branched Amorphous Lithium Sulfonated Polyester Resin Derived from 3 Mole Percent of Lithio 5-Sulfoisophthalic Acid A branched amorphous sulfonated polyester resin comprised of 0.47 mole equivalent of terephthalate, 0.030 mole equivalent of lithio 5-sulfoisophthalic acid, 0.351 mole equivalent of 1,2-propanediol, and 0.031 mole equivalent of diethylene glycol, 0.116 mole equivalent of dipropylene glycol, and trimethylolpropane as branching agent (0.02 mole equivalent) was prepared as follows. In a two-liter Hoppes reactor equipped with a heated bottom drain valve, high viscosity double turbine agitator, and distillation receiver with a cold water condenser was charged 853 grams of dimethylterephthalate, 70.8 grams of lithio 5-sulfoisophthalic acid, 658.1 grams of 1,2-propanediol (1 mole excess of glycols), 57.0 grams of di-ethylene glycol, (1 mole excess of glycols), 236.9 grams of dipropylene glycol, trimethylolpropane (11 grams) and 1.5 grams of butyltin hydroxide oxide as the catalyst. The reactor was heated to 190° C. with stirring for 3 hours and then again heated to 210° C. over a one hour period, after which the pressure was slowly reduced from atmospheric pressure to about 260 Torr over a one hour period, and then reduced to 5 Torr over a two hour period. The pressure was then further reduced to about 1 Torr over a 30 minute period and the polymer was discharged through the bottom drain onto a container cooled with dry ice to yield 895 grams of 3 mole percent sulfonated-polyester resin. The branched sulfonated-polyester resin had a glass transition temperature measured to be 61.5° C. (onset) and a softening point of 163° C. An aqueous emulsion of the resin was then prepared by dissolving the said resin (200 grams) in 2 Liters of acetone, and adding the dissolved solution drop wise (over a 2 hour period) into a 4 liter kettle equipped with a heating mantle, a mechanical stirrer and distillation apparatus, and comprised of 2.25 liters of water heated to 80° C. The acetone was collected in the distillation receiver. The aqueous resin emulsion displayed a particle size of 205 nanometers.

EXAMPLE III

Preparation of a Branched Amorphous Lithium Sulfonated Polyester Resin Derived from 4 Mole Percent of Lithio 5-Sulfoisophthalic Acid A branched amorphous sulfonated polyester resin comprised of 0.46 mole equivalent of terephthalate, 0.040 mole equivalent of lithium 5-sulfoisophthalic acid, 0.351 mole equivalent of 1,2-propanediol, and 0.031 mole equivalent of diethylene glycol, 0.116 mole equivalent of dipropylene glycol, and trimethylolpropane as branching agent (0.02 mole equivalent) was prepared as follows. In a two-liter Hoppes reactor equipped with a heated bottom drain valve, high viscosity double turbine agitator, and distillation receiver with a cold water condenser was charged 835.6 grams of dimethylterephthalate, 94.3 grams of lithium 5-sulfoisophthalic acid, 658.1 grams of 1,2-propanediol (1 mole excess of glycols), 57.0 grams of diethylene glycol, (1 mole excess of glycols), 236.9 grams of dipropylene glycol, trimethylolpropane (11 grams) and 1.5 grams of butyltin hydroxide oxide as the catalyst. The reactor was heated to 190° C. with stirring for 3 hours and then again heated to 210° C. over a one hour period, after which the pressure was slowly reduced from atmospheric pressure to about 260 Torr over a one hour period, and then reduced to 5 Torr over a two hour period. The pressure was then further reduced to about 1 Torr over a 30 minute period and the polymer was discharged through the bottom drain onto a container cooled with dry ice to yield 870 grams of 4 mole percent sulfonated-polyester resin. The branched sulfonated-polyester resin had a glass transition temperature measured to be 63.0° C. (onset) and a softening point of 171° C. An aqueous emulsion of the resin was then prepared by adding the above resin to a 4 liter kettle. Equipped with a mechanical stirrer and heating mantle, and comprised of 2.25 liters of water heated to 95° C. The heating (95° C.) was maintained for about 1.5 hours, and then allowed to cool to room temperature to result in an aqueous polyester emulsion with a particle size of 155 nanometers.

EXAMPLE IV

Preparation of a Branched Amorphous Sodium Sulfonated Polyester Resin Derived from 2 Mole Percent of Sodio 5-Sulfoisophthalic Acid A branched amorphous sulfonated polyester resin comprised of 0.48 mole equivalent of terephthalate, 0.020 mole equivalent of sodio 5-sulfosulfoisophthalic acid, 0.351 mole equivalent of 1,2-propanediol, and 0.031 mole equivalent of diethylene glycol, 0.116 mole equivalent of dipropylene glycol, and trimethylolpropane as branching agent (0.02 mole equivalent) was prepared as follows. In a two-liter Hoppes reactor equipped with a heated bottom drain valve, a high viscosity double turbine agitator, and a distillation receiver with a cold water condenser was charged 872 grams of dimethylterephthalate, 50.2 grams of sodio 5-sulfoisophthalic acid, 658.1 grams of 1,2-propanediol (1 mole excess of glycols), 57.0 grams of diethylene glycol, (1 mole excess of glycols), 236.9 grams of dipropylene glycol, trimethylolpropane (11 grams) and 1.5 grams of butyltin hydroxide oxide as the catalyst. The reactor was heated to 190° C. with stirring for 3 hours and then again heated to 210° C. over a one hour period, after which the pressure was slowly reduced from atmospheric pressure to about 260 Torr over a one hour period, and then reduced to 5 Torr over a two hour period. The pressure was then further reduced to about 1 Torr over a 30 minute period and the polymer was discharged through the bottom drain onto a container cooled with dry ice to yield 880 grams of 2 mole percent sulfonated-polyester resin. The branched sulfonated-polyester resin had a glass transition temperature measured to be 62.5° C. (onset) and a softening point of 160° C. An aqueous emulsion of the resin was then prepared by dissolving the said resin (200 grams) in 2 Liters of acetone, and adding the dissolved solution drop wise (over a 2 hour period) into a 4 liter kettle, equipped with a heating mantle, a mechanical stirrer and distillation apparatus, and comprised of 2.25 liters of water heated to 80° C. The acetone was collected in the distillation receiver. The aqueous resin emulsion displayed a particle size of 220 nanometers.

EXAMPLE V

Preparation of Crystalline Lithium Sulfonated Polyester Resin (CSPE) Derived from 3.5 Mole Percent of Lithio 5-Sulfoisophthalic Acid A crystalline linear sulfonated polyester resin comprised of 0.465 mole equivalent of sebacic acid, 0.035 mole equivalent of lithio 5-sulfoisophthalic acid and 0.500 mole equivalent of ethylene glycol was prepared as follows. In a two-liter Hoppes reactor equipped with a heated bottom drain valve, high viscosity double turbine agitator, and distillation receiver with a cold water condenser were charged 900 grams of sebacic acid, 84 grams of lithio 5-sulfosulfoisophthalic acid, 655.2 grams of ethylene glycol, and 1.5 grams of butyltin hydroxide oxide as the catalyst. The reactor was heated to 190° C. with stirring for 3 hours and then heated to 210° C. over a one hour period, after which the pressure was slowly reduced from atmospheric pressure to about 260 Torr over a one hour period, and then reduced to 5 Torr over a two hour period, and then further reduced to about 1 Torr over a 30 minute period. The polymer was discharged through the bottom drain onto a container full of ice water to yield 1000 grams of 3.5 mole percent sulfonated-polyester resin. The sulfonated-polyester resin had a softening point of 93° C. (29 Poise viscosity measured by Cone & Plate Viscometer at 199° C.) and a melting point range of 60 to 80° C. as measured by DSC. An aqueous emulsion of the resin was then prepared by adding the above resin to a 4 Liter kettle. Equipped with a mechanical stirrer and heating mantle, and comprised of 2.25 liters of water heated to 95° C. The heating (95° C.) was maintained for about 1.5 hours, and then allowed to cool to room temperature to result in an aqueous polyester emulsion with a particle size of 155 nanometers.

EXAMPLE VI

Preparation of Crystalline Sodium Sulfonated Polyester Resin (CSPE) Derived from 3.5 Mole Percent of Sodio 5-Sulfoisophthalic Acid A crystalline linear sulfonated polyester resin comprised of 0.465 mole equivalent of sebacic acid, 0.035 mole equivalent of sodio 5-sulfosulfoisophthalate and 0.500 mole equivalent of ethylene glycol was prepared as follows. In a two-liter Hoppes reactor equipped with a heated bottom drain valve, high viscosity double turbine agitator, and distillation receiver with a cold water condenser were charged 900 grams of sebacic acid, 89.3 grams of sodium 5-sulfosulfoisophthalic acid, 655.2 grams of ethylene glycol, and 1.5 grams of butyltin hydroxide oxide as the catalyst. The reactor was heated to 190° C. with stirring for 3 hours and then heated to 210° C. over a one hour period, after which the pressure was slowly reduced from atmospheric pressure to about 260 Torr over a one hour period, and then reduced to 5 Torr over a two hour period, and then further reduced to about 1 Torr over a 30 minute period. The polymer was discharged through the bottom drain onto a container full of ice water to yield 1100 grams of 3.5 mole percent sulfonated-polyester resin. The sulfonated-polyester resin had a softening point of 95° C. (30 Poise viscosity measured by Cone & Plate Viscometer at 199° C.) and a melting point range of 60 to 80° C. as measured by DSC. An aqueous emulsion of the resin was then prepared by adding the above resin to a 4 liter kettle. Equipped with a mechanical stirrer and heating mantle, and comprised of 2.25 liters of water heated to 95° C. The heating (95° C.) was maintained for about 1.5 hours, and then allowed to cool to room temperature to result in an aqueous polyester emulsion with a particle size of 125 nanometers.

EXAMPLE VII

Preparation of Crystalline Lithium Sulfonated Polyester Resin (CSPE) Derived from 1.5 Mole Percent of Lithio 5-Sulfoisophthalic Acid A crystalline linear sulfonated polyester resin comprised of 0.485 mole equivalent of sebacic acid, 0.015 mole equivalent of lithio 5-sulfoisophthalic acid and 0.500 mole equivalent of ethylene glycol was prepared as follows. In a two-liter Hoppes reactor equipped with a heated bottom drain valve, high viscosity double turbine agitator, and distillation receiver with a cold water condenser were charged 901.8 grams of sebacic acid, 36.2 grams of lithio 5-sulfosulfoisophthalic acid, 655.2 grams of ethylene glycol, and 1.5 grams of butyltin hydroxide oxide as the catalyst. The reactor was heated to 190° C. with stirring for 3 hours and then heated to 210° C. over a one hour period, after which the pressure was slowly reduced from atmospheric pressure to about 260 Torr over a one hour period, and then reduced to 5 Torr over a two hour period, and then further reduced to about 1 Torr over a 30 minute period. The polymer was discharged through the bottom drain onto a container full of ice water to yield 1080 grams of 1.5 mole percent sulfonated-polyester resin. The sulfonated-polyester resin had a softening point of 85° C. (19 Poise viscosity measured by Cone & Plate Viscometer at 199° C.) and a melting point range of 60 to 80° C. as measured by DSC. An aqueous emulsion of the resin was then prepared by dissolving the said resin (200 grams) in 2 liters of acetone, and adding the dissolved solution drop wise (over a 2 hour period) into a 4 liter kettle, equipped with a heating mantle, a mechanical stirrer and distillation apparatus, and comprised of 2.25 liters of water heated to 80° C. The acetone was collected in the distillation receiver. The aqueous resin emulsion displayed a particle size of 125 nanometers.

EXAMPLE VIII

Preparation of Crystalline Sodium Sulfonated Polyester Resin (CSPE) Derived from 1.5 Mole Percent of Sodio 5-Sulfoisophthalic Acid A crystalline linear sulfonated polyester resin comprised of 0.485 mole equivalent of sebacic acid, 0.015 mole equivalent of lithio 5-sulfoisophthalic acid and 0.500 mole equivalent of ethylene glycol was prepared as follows. In a two-liter Hoppes reactor equipped with a heated bottom drain valve, high viscosity double turbine agitator, and distillation receiver with a cold water condenser were charged 901.8 grams of sebacic acid, 36.2 grams of lithio 5-sulfosulfoisophthalic acid, 655.2 grams of ethylene glycol, and 1.5 grams of butyltin hydroxide oxide as the catalyst. The reactor was heated to 190° C. with stirring for 3 hours and then heated to 210° C. over a one hour period, after which the pressure was slowly reduced from atmospheric pressure to about 260 Torr over a one hour period, and then reduced to 5 Torr over a two hour period, and then further reduced to about 1 Torr over a 30 minute period. The polymer was discharged through the bottom drain onto a container full of ice water to yield 1080 grams of 1.5 mole percent sulfonated-polyester resin. The sulfonated-polyester resin had a softening point of 85° C. (19 Poise viscosity measured by Cone & Plate Viscometer at 199° C.) and a melting point range of 60 to 80° C. as measured by DSC. An aqueous emulsion of the resin was then prepared by dissolving the said resin (200 grams) in 2 liters of acetone, and adding the dissolved solution drop wise (over a 2 hour period) into a 4 liter kettle, equipped with a heating mantle, a mechanical stirrer and distillation apparatus, and comprised of 2.25 liters of water heated to 80° C. The acetone was collected in the distillation receiver. The aqueous resin emulsion displayed a particle size of 125 nanometers.

EXAMPLE IX

Toner Compositions

A toner comprised of 9 weight percent Carnauba wax, 5 weight percent Pigment Blue 15:3 Colorant, 68.8 weight percent of branched lithio-sulfonated polyester resin of Example I, 17.2 percent of crystalline lithio-sulfonated polyester resin of Example V, was prepared as follows.

A 964 milliliter colloidal solution containing 634 grams of 15 percent by weight of the branched 2.0% lithio-sulfonated polyester resin (Example I) and 330 grams of 7.3 percent by weight of the crystalline 1.5% lithio-sulfonated polyester resin (Example V) was charged into a 2 liter BUCHI reactor equipped with a mechanical stirrer containing two P4 45 degree angle blades. To this was added 64 grams of 19.7 percent by weight of a Carnauba wax dispersion, as well as 29.6 grams of a cyan pigment dispersion containing 28.6 percent by weight of Pigment Blue 15:3 (made in-house with NEOGEN RK surfactant). The resulting mixture was heated to 67° C. over 45 minutes with stirring at 600 revolutions per minute. To this heated mixture was then added drop-wise 181 grams of an aqueous solution containing 3.5 percent by weight of zinc acetate dihydrate. The drop-wise addition of the zinc acetate dihydrate solution was accomplished utilizing a peristaltic pump, at a rate of addition of approximately 0.5 milliliters per minute. The entire zinc acetate solution was added over the first 337 minutes. At 261 minutes, the temperature of the reaction was increased to 68° C. The reaction was turned off or heating was stopped overnight at 367 minutes and reheated the next day to 67° C. for an extra 121 minutes to give a total reaction time of 488 minutes. The mixture was allowed to cool to room temperature and then retrieved from the BUCHI reactor. The mixture included particles having a particle size of 12.5 microns with a GSD of 1.41 as measured by the COULTER COUNTER. The product was sieved through a 25 micron stainless steel screen (500 mesh) and filtered. The wet cake, was then washed by reslurring in water and stirring for 1 hour followed by filtration. This washing procedure was repeated one more time, followed by drying the toner utilizing the freeze drier over 72 hours.

EXAMPLE X

Toner Compositions

A toner comprised of 9 weight percent Carnauba wax, 5 weight percent Pigment Blue 15:3 Colorant, 68.8 weight percent of branched lithio-sulfonated polyester resin of Example II, 17.2 percent of crystalline sodio-sulfonated polyester resin of Example VIII, was prepared as follows.

A 964 milliliter colloidal solution containing 634 grams of 15 percent by weight of the branched 3.0% lithio-sulfonated polyester resin (Example II) and 330 grams of 7.3 percent by weight of the crystalline 1.5% sodio-sulfonated polyester resin (Example VIII) was charged into a 2 liter BUCHI reactor equipped with a mechanical stirrer containing two P4 45 degree angle blades. To this emulsion mixture was added 68.5 grams of Carnauba wax emulsion of 19.7 percent and 31.5 grams of an aqueous pigment blue 15:2 dispersion of 28.6 percent. The pH of the mixture was measured to be 4.59, and 0.59 grams acetic acid was used to lower the pH to 4.00 before charging the solution into a 2 liter BUCHI reactor. The mixture was stirred at 600 rpm and heated to 68° C. To this mixture was added 100 grams of a zinc acetate solution containing 3.8 grams of zinc acetate dihydrate, 96.2 grams of water and 0.59 grams of acetic acid at a rate of 1 milliliter per minute. The reaction was further heated for 100 min at 68° C. before cooling to room temperature while stirring. The next morning loosely formed aggregates of a size diameter of 1.7 micrometers and a Geometric Standard Deviation ("GSD") of 1.33 had formed. The temperature of the mixture was ramped to 48° C. and the particle size was monitored over about 360 minutes as the temperature was slowly raised to 55° C. to give aggregates of a size diameter of 3.6 micrometers and a GSD of 1.23. Again the solution was cooled overnight with stirring then reheated to 54° C. the following day. The particle diameter of 5.5 micrometers and a GSD of 1.21 the pH of the solution was adjusted to 5.5 with 4% sodium hydroxide to inhibit the growth of the particles. The pH was further adjusted to 5.8 and the temperature was slowly increased to 70.6° C. at which point the particles coalesced to form toner particles of a size diameter of 5.4 micrometers and a GSD of 1.23. The reactor was then cooled down to room temperature and the resulting particles was sieved through a 25 micron stainless steel screen (500 mesh) and filtered. The wet cake, was then washed by re-slurring in water and stirring for 1 hour followed by filtration. This washing procedure was repeated one more time, followed by drying the toner utilizing the freeze drier over 72 hours.

EXAMPLE XI

Toner Compositions

A toner comprised of 9 weight percent Carnauba wax, 5 weight percent Pigment Blue 15:3 Colorant, 64.5 weight percent of branched lithio-sulfonated polyester resin of Example I, 21.5 percent of crystalline lithio-sulfonated polyester resin of Example VII, was prepared as follows.

A 10 liter reactor equipped with a mechanical stirrer, bottom drain valve and inline IKA homogenizer, was charged with 4.07 Kg of an aqueous dispersion of lithio branched amorphous polyester resin of Example I (13.06% solids), 1.59 kg of an aqueous dispersion of lithio crystalline polyester resin of Example VII (11.13% solids), 0.210 kg of an aqueous dispersion of cyan Pigment Blue 15:3 pigment (26% solids) available from Sun Chemicals, and 0.395 kg of an aqueous dispersion of Carnauba wax (19.65% solids). The reactor contents were mixed at 100 rpm and the pH of the mixture was adjusted to 4.0 using 2.85 g of 98% acetic acid. In a separate 1 liter flask, a solution was prepared by dissolving 24.78 g of zinc acetate in 627.37 g of water, and the pH of the solution was adjusted to 4.2 using 15.43 g of 98% Acetic acid. The zinc acetate solution was added to the 10 Liter reactor utilizing a piston pump over a duration of 13 min period while the contents of the reactor was stirred at 340 rpm, and the homogenizer operated at 2000-2500 rpm with. After the addition of the zinc acetate solution, the homogenization was continued for an additional 47 minutes. The homogenizer loop was then flushed with 0.323 kg of DI water. The reactor was then heated to 40 C over a 30 minute interval, and then the temperature was slowly increased to 50 C over 157 min until a particle size ($D_{50}$) of 5.90-6.00 μm was attained. The particle size was then stabilized at 5.90-6.00 μm by lowering the pH to 5.9 using 310.5 g of an aqueous solution of sodium hydroxide (4%). The toner particles were then coalesced by heating the mixture to 70° C. over a 135 min period, and the temperature was maintained for an additional 31 minutes until the circularity of the toner particle was 0.980, as measured by, the Flow Particle Image Analyzer (FPIA). The reactor content was then cooled to room temperature, discharged through the bottom drain valve, and screen through 25 μm sieve to result in a toner yield of 98.7%. The toner slurry was then filtered, washed repeatedly with water until the water filtrate displayed a conductivity of <25 μS/cm and freeze dried. The dried toner displayed a particle size of 6.02 microns and GSD of 1.23 with a circularity of 0.977.

EXAMPLE XII

Toner Compositions

A toner comprised of 9 weight percent Carnauba wax, 5 weight percent Pigment Blue 15:3 Colorant, 64.5 weight percent of branched sodio-sulfonated polyester resin of Example IV, 21.5 percent of crystalline lithio-sulfonated polyester resin of Example V, was prepared as follows.

In a 2 L beaker, 805.10 g of 2 mole percent of sodio-sulfonated branched polyester resin of Example IV, 147.33 g of 3.5 mole percent of lithio-sulfonated crystalline polyester of Example V, 27.27 g of cyan pigment dispersion Cyan 15:3, 28.6% solids) and 55.21 g of carnauba wax dispersion (batch dispersed with 3.5 pph HSPE-2-to-wax ratio, EAWAX-93, 21.19% solids) was added and the homogenization began. Homogenization was carried out with an IKA Ultra Turrax T50 probe homogenizer at 3000 rpm. Then, 2.8% of a 3% zinc acetate solution was pipetted to the resin solids over an 8 minute period. As the slurry began to thicken the homogenizer speed was increased to 4000 rpm. The pH of the slurry at 23.7° C. was 5.43. The slurry was then transferred to the 2 L BUCHI reactor and agitation began at 600 rpm ($D_{50}$/GSDv/GSDn 3.25/1.48/1.41). Particle size measurements were done with a COULTER COUNTER particle size analyzer to track the particle growth. The reactor was heated to a temperature of 40° C. at 1° C./min. At 40° C. the toner particles aggregates were 5.54 microns with GSD of 1.27. The temperature was increased to 45° C. at 700 rpm. The agitation speed was increased in terms of rpm to prevent quick growth of the toner particles with the increase in temperature. At 45° C. and 700 rpm the toner particles were 5.65/1.27/1.32. Again the temperature and rpm were increased to 50° C. and 750. The toner particles were 5.60/1.27/1.33. The temperature was increased from 50 to 60° C., and the pH was 5.36 at 61.7° C. A sample taken at the reactor temperature of 63.5° C. yielded particles having a size of 5.37/1.26/1.31, coalesced and spherical. Then cooling began at 1.9° C./min. The final toner particle size was 5.60/1.24/1.31, with a pH 5.35 (21° C.), and spherical. Total dry toner yield was 113 g from a 130 g theoretical with 0.69 g coarse (>25 micron).

EXAMPLE XIII

Toner Compositions

A toner comprised of 9 weight percent Carnauba wax, 5 weight percent Pigment Blue 15:3 Colorant, 64.5 weight percent of branched lithio sulfonated polyester resin of Example II, 21.5 percent of crystalline sodio sulfonated polyester resin of Example VI, was prepared as follows.

In a 2 L NALGENE beaker, 605.7 grams of 15.5 percent by weight of the branched 3.0% branched amorphous lithio-sulfonated polyester resin of Example II, 297.9 grams of 7.9 percent by weight of the crystalline 3.5% sodio-sulfonated polyester resin of Example VI, 35.4 grams of 35.1 percent by weight of a Carnauba wax dispersion (EAWAX-93, prepared in-house), as well as 31.3 grams of a cyan pigment dispersion containing 26.5 percent by weight of Pigment Blue 15:3 (made in-house with NEOGEN RK surfactant, and Cyan 15:3). After uniform mixing, the pH of the slurry was measured and adjusted from 4.17 to 4.85 with 0.38 grams of 1M NaOH. A zinc acetate dihydrate solution of 3.5 wt. % (3.3 g zinc acetate dehydrate in 90 g deionized water) was added at ambient temperature via a peristaltic pump over 13 minutes to the pre-toner slurry while homogenizing the slurry with an IKA Ultra Turrax T50 probe homogenizer at 3000 rpm. As the slurry began to thicken the homogenizer rpm was increased to 4000 while shifting the beaker side-to-side. The $D_{50}$ and GSD (by volume) were measured to be 5.42 and 1.84, consecutively, with the COULTER COUNTER Particle Size Analyzer.

This 1.1 L solution was charged into a 2 liter BUCHI reactor equipped with a mechanical stirrer containing two P4 45 degree angle blades. The heating was programmed to reach 50° C. over 45 minutes with stirring at 700 rpm. After 37 minutes at 50° C., the $D_{50}$ particle size of the toner had already reached 6.41 μm with minimal growth. The temperature was then increased to 63° C. and then 66° C., so that the aggregates would properly coalesce into spherical particles. The reaction was turned off or heating was stopped once the particles coalesced at 66° C. with a total reaction time of 160 minutes. The toner slurry was then allowed to cool to room temperature, about 25° C., overnight, for about 18 hours, with stirring at 850 rpm. The next day a sample (about 0.25 gram) of the reaction mixture was then retrieved from the BUCHI reactor, and a particle size of 6.83 microns with a GSD of 1.43 was measured by the COULTER COUNTER. The product was filtered through a 25 micron stainless steel screen (#500 mesh), left in its mother liquor and settled overnight. The next day the mother liquor, which contained fines, was decanted from the toner cake which settled to the bottom of the beaker. The settled toner was reslurried in 1.5 liter of deionized water, stirred for 30 minutes, and then settled again overnight. This procedure was repeated once more until the solution conductivity of the filtrate was measured to be about 25 microsiemens per centimeter which indicated that the washing procedure was sufficient. The toner cake was redispersed into 400 millimeters of deionized water, and freeze-dried over 72 hours. The final dry yield of toner is estimated to be 80% of the theoretical yield.

EXAMPLE XIV

Toner Compositions

A toner comprised of 9 weight percent Carnauba wax, 5 weight percent Pigment Blue 15:3 Colorant, 64.5 weight percent of branched sodio-sulfonated polyester resin of Example III, 21.5 percent of crystalline lithio-sulfonated polyester resin of Example VII, was prepared as follows.

A 964 milliliter colloidal solution containing 634 grams of 15 percent by weight of the branched 4.0% lithio-sulfonated polyester resin (Example III) and 330 grams of 7.3 percent by weight of the crystalline 1.5% lithio-sulfonated polyester resin (Example VII) was charged into a 2 liter BUCHI reactor equipped with a mechanical stirrer containing two P4 45 degree angle blades. To this emulsion mixture was added 68.5 grams of Carnauba wax emulsion of 19.7 percent and 31.5 grams of an aqueous pigment blue 15:2 dispersion of 28.6 percent. The pH of the mixture was measured to be 4.59 and 0.59 grams acetic acid was used to lower the pH to 4.00 before charging the solution into a 2 liter BUCHI reactor. The mixture was stirred at 600 rpm and heated to 68° C. To this mixture was added 100 grams of a zinc acetate solution containing 3.8 grams of zinc acetate dihydrate, 96.2 grams of water and 0.59 grams of acetic acid at a rate of 1 milliliter per minute. The reaction was further heated for 100 min at 68° C. before cooling to room temperature while stirring. The next morning loosely formed aggregates of a size diameter of 1.6 micrometers and a Geometric Standard Deviation ("GSD") of 1.32 had formed. The temperature of the mixture was ramped to 48° C. and the particle size was monitored over about 360 minutes as the temperature was slowly raised to 55° C. to give aggregates of a size diameter of 3.6 micrometers and a GSD of 1.23. Again the solution was cooled overnight with stirring and then reheated to 54° C. the following day. The particles had a diameter of 5.5 micrometers and a GSD of 1.21. The pH of the solution was adjusted to 5.5 with 4% sodium hydroxide to inhibit the growth of the particles. The pH was further adjusted to 5.8 and the temperature was slowly increased to 70.6° C. at which point the particles coalesced to form toner particles of a size diameter of 5.9 micrometers and a GSD of 1.22. The reactor was then cooled down to room temperature and the resulting particles was sieved through a 25 micron stainless steel screen (500 mesh) and filtered. The wet cake was then washed by re-slurrying in water and stirring for 1 hour followed by filtration. This washing procedure was repeated one more time, followed by drying the toner utilizing the freeze drier over 72 hours.

Results

Fusing

The toners of Examples IX to XII, were evaluated using the XEROX Docucolor DC2240 printer. The toners were fused at 194 mm/s onto Color Xpressions (90 gsm) paper for gloss and minimum fixing temperature (MFT) while hot offset performance was examined with the samples printed on S paper (60 gsm) and the fuser running at 104 mm/s. The fusing performance of the toners are listed in Table 1.

TABLE 1

| Toner | MFT | Hot-Offset |
|---|---|---|
| Example IX | 120 | 200 |
| Example X | 121 | 200 |
| Example XI | 129 | 210 |
| Example XII | 125 | 210 |
| Example XIII | 115 | 200 |
| Example XIV | 119 | 190 |

The toner compositions according to the present exemplary embodiment also exhibit satisfactory charging performance. Specifically, the toners exhibit both satisfactory C-zone and A-zone charging. The toners that included both lithium sulfonated branched amorphous polyester resins and lithium sulfonated crystalline polyester resins did exhibit higher C-zone and A-zone charging when compared to toners comprising sodium sulfonated polyester resins as both the amorphous and crystalline polyester resin.

Thus, toner compositions and a process for preparing such compositions has been provided. The toners comprising a combination of an alkali sulfonated branched amorphous polyester and an alkali sulfonated crystalline polyester resin exhibit properties making them suitable for use as low melt toners in electrostatographic or xerographic processes. The toners exhibit good C-zone and A-zone charging and a satisfactory fusing latitude. In particular, toners wherein the alkali metal in the polyester resins is lithium provide a useful toner. Additionally, the method according to the present exemplary embodiment provides a process for preparing low melt and ultra low melt toners that allows for controlling particle growth and morphology and provides high yields. The process is particularly useful in preparing toners comprising a combination of a crystalline polyester emulsion and a wax dispersion.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A process for preparing a low-melt toner, the process comprising:

forming a pre-toner mixture comprising a first alkali sulfonated branched polyester resin, a second alkali sulfonated crystalline polyester resin and a colorant;

adding an aggregating agent to the pre-toner mixture and aggregating the mixture to form an aggregate mixture comprising a plurality of aggregate toner particles;

adjusting the pH of the aggregate mixture to between about 5 and about 7;

coalescing the aggregate mixture at a temperature of from about 5 to about 20° C. above the glass transition temperature ($T_g$) of one of the first or second alkai sulfonated polyester resins to form a mixture of coalesced toner particles; and cooling the mixture of coalesced toner particles.

2. The process according to claim 1, wherein the first and second polyester resins each comprise an alkali metal independently selected from the group consisting of lithium, sodium, potassium and combinations thereof.

3. The process according to claim 2, wherein the alkali metal is lithium.

* * * * *